US012102209B2

(12) United States Patent
Taylor

(10) Patent No.: US 12,102,209 B2
(45) Date of Patent: Oct. 1, 2024

(54) BEAUTY SPONGE GRIPPER AND STAND

(71) Applicant: Tammy Taylor, Huntington Beach, CA (US)

(72) Inventor: Tammy Taylor, Huntington Beach, CA (US)

( * ) Notice: Subject to any disclaimer, the term of this patent is extended or adjusted under 35 U.S.C. 154(b) by 913 days.

(21) Appl. No.: 17/020,503

(22) Filed: Sep. 14, 2020

(65) Prior Publication Data

US 2021/0076806 A1 Mar. 18, 2021

Related U.S. Application Data

(60) Provisional application No. 62/899,422, filed on Sep. 12, 2019.

(51) Int. Cl.

| | |
|---|---|
| ***A45D 40/26*** | (2006.01) |
| ***A45D 33/34*** | (2006.01) |
| ***A45D 34/04*** | (2006.01) |
| *A45D 33/00* | (2006.01) |
| *A45D 34/00* | (2006.01) |
| *A45D 40/00* | (2006.01) |

(52) U.S. Cl.

CPC ..... *A45D 40/26* (2013.01); *A45D 33/34* (2013.01); *A45D 34/04* (2013.01); *A45D 2033/001* (2013.01); *A45D 2034/002* (2013.01); *A45D 2040/0006* (2013.01); *A45D 2200/1009* (2013.01)

(58) Field of Classification Search

CPC ..... Y10T 24/44385; Y10T 24/44444; Y10T 24/4447; A45D 33/34; A45D 33/36; A45D 34/04; A45D 40/26; A45D 40/28; A45D 2200/1009; A45D 2200/1018; A45D 2033/001; A45D 2034/002; A45D 2040/006

USPC ..... 24/499, 500, 510

See application file for complete search history.

(56) References Cited

U.S. PATENT DOCUMENTS 385,650 A * 7/1888 Wemple
2,955,603 A * 10/1960 Hauser ..... A45D 2/2407 D28/35

(Continued)

FOREIGN PATENT DOCUMENTS

WO WO-2018073556 A1 * 4/2018

*Primary Examiner* — Dean J Kramer

(74) *Attorney, Agent, or Firm* — Myers Andras Ashman & Bisol LLP; Joseph C. Andras

(57) ABSTRACT

A beauty sponge gripper and stand that is adapted for being held by a user and gripping a beauty sponge for controlled application and blending of makeup that has been applied to the beauty sponge to the user's face without requiring the user to directly hold the sponge and for supporting the beauty sponge above a countertop without contacting other surfaces that would otherwise be soiled by the makeup for temporarily setting the beauty sponge down or for drying the beauty sponge between uses. The gripper stand includes a base portion with a bottom end that reliably rests on a flat surface and a gripper portion extending upward from the top end of the base portion. The gripper arms include sponge contact portions that collectively define a sponge-gripping gap between the top ends of the left and right gripper arms that is wider in the central area than near the front or rear areas of the gripper arms so that the beauty sponge is held without formation of a fold line.

10 Claims, 22 Drawing Sheets

(56) References Cited

U.S. PATENT DOCUMENTS

| | | | | | |
|---|---|---|---|---|---|
| 3,030,681 | A * | 4/1962 | Phillips | G09F 3/16 | 248/230.4 |
| 3,060,637 | A * | 10/1962 | Fumeaux | A01G 7/00 | 47/2 |
| 4,175,306 | A * | 11/1979 | Bigelow | D06F 55/02 | 24/507 |
| 4,685,464 | A * | 8/1987 | Goldberger | A61B 5/14552 | D24/169 |
| 7,559,125 | B2 * | 7/2009 | Cofer | A61M 5/1418 | 24/500 |
| 9,743,867 | B2 * | 8/2017 | Fujii | A61B 5/6826 | |
| 2005/0228248 | A1 * | 10/2005 | Dietiker | A61B 5/6826 | 600/323 |
| 2018/0360188 | A1 * | 12/2018 | Quagliara | A45D 29/007 | |

* cited by examiner

BEAUTY SPONGE GRIPPER AND STAND

CROSS-REFERENCE TO RELATED APPLICATIONS

This application claims the benefit of provisional patent application No. 62/899,422, filed Sep. 12, 2019, the entire contents of which are hereby incorporated by reference.

BACKGROUND

Field of the Invention

The present invention relates generally to makeup and tools used for application of makeup and, more particularly, to a beauty sponge gripper and stand.

Description of the Related Art

The beauty market contains numerous kinds of makeup. It varies from user to user, but the essentials might include foundation, concealer, a blush/bronzer duo, highlighter, eyeshadow, eyeliner, mascara, brow pencils, and lipstick.

The market also contains a wide variety of tools for applying makeup to the face, such as brushes, cloth pads, circular sponge puffs, and handheld beauty sponges. Beauty sponges, also called "sponge applicators," are especially popular for application and blending of foundation and concealer. Beauty sponges often have an egg-shape that features a broad round end and a narrower tip that comes to a point. One popular egg-shaped beauty sponge is sold by Rea.deeming Beauty, Inc. under the brand BEAUTYBLENDER®.

Beauty sponges come in a variety of sizes. As shown in FIG. 1, for example, egg-shaped sponges sometimes come in small (about ¾" in width), to medium (about 1" in width), to large (about 1½" in width).

Beauty sponges also come in many shapes. Some beauty sponges, for example, have a distinct bevel (FIG. 2), an egg shape with a bulbous base (FIG. 3), or a bullet shape (a flat end, a cylindrical body, and a narrow tip that comes to a point)(FIG. 4). Others are multi-faceted (FIG. 5). And others are wedge shaped, i.e. with six distinct faces and with a flat broad end and a narrow thin end (FIG. 6). The possibilities are endless.

Although the exact material used to make the sponge is not critical to the invention, to the inventor's best understanding, beauty sponges are sometimes made from silicone, sometimes from a variety of latex, and sometimes from more porous materials such as hydrophilic polyurethane. In the latter case, the sponge is pre-wet for use and then the makeup to be applied by the user is imparted to the sponge for manual application to the user's face. The porous sponge material, in addition to being non-latex which is an issue for some who have allergies, are better at providing for smoother, more even blending in that it absorbs excess makeup and does not just push makeup around on the face.

Conventionally, when being prepared for use, the dry beauty sponge is saturated with water by being dipped into a container full of water or simply held under the faucet, squeezed of excess water, and lightly towel-dried. Then, using the makeup of choice such as liquid makeup, cream makeup, mineral powders, wet/dry powders, and/or cream blushes, the makeup is poured onto the sponge (see e.g. FIG. 7) or the sponge is dipped into the makeup which was previously applied to a flat surface or palette (see e.g. FIG. 8). Finally, the beauty sponge with the makeup thereon is firmly held between two or more of the user's fingers and used to stipple or dab the selected makeup onto the user's face (see FIG. 9). The broader round end of the beauty sponge is used to stipple makeup onto larger, flatter areas (e.g. forehead, cheeks, and chin), while the narrower tip of the beauty sponge is used to apply makeup to smaller, harder to reach locations (e.g. in the deep, narrow spaces between the nose and the eyes).

Beauty sponges are an excellent tool for applying makeup and for smoothly blending the makeup on the user's skin. However, a problem with beauty sponges is that the user directly holds the sponge such that the makeup being applied gets on the user's fingers, especially if the user is rotating the sponge in her fingers to use its various surfaces or ends or to smooth the makeup already applied. As a result, the makeup on the sponge is often transferred to the user's fingers and then inadvertently spread into undesired locations. Another problem with beauty sponges is that they are used wet and rinsed with water after use, so it is necessary to dry them between uses. However, because the users are holding them in their fingers in use, many users simply set them down on the counter or toss them into their makeup bag where they soil other items.

There remains a need, therefore, for a beauty sponge gripper and stand that securely grips a wide variety of beauty sponges to provide for feel and control without requiring direct finger contact and without damaging the beauty sponge during application of makeup to the user's face, and that provides a built-in stand for short-term placement on the countertop and long-term drying.

SUMMARY OF THE INVENTION

The present invention provides structures and methods which overcome the deficiencies in the prior art.

In a first aspect, the invention resides in a beauty sponge gripper and stand system that is adapted for being held by a user and gripping a beauty sponge for controlled application and blending of makeup that has been applied to the beauty sponge onto the user's face without requiring the user to directly hold the sponge and for supporting the beauty sponge above a countertop without contacting surfaces that would otherwise be soiled by the makeup while temporarily setting the beauty sponge down or for drying the beauty sponge between uses. In a preferred embodiment, the inventions more specifically comprises a gripper portion formed from left and right gripper arms that have a bottom end and a top end, the bottom ends of the gripper arms pivotally connected to one another about a pivot axis, the top ends of the gripper arms each having a sponge contact portion along a depth that is parallel to the pivot axis and that runs from a front area, to a central area, to a rear area of the top end of the left and right gripper arms, the sponge contact portions facing one another along the depth thereof for releasably engaging with the beauty sponge, the sponge contact portions at the top ends of the left and right gripper arms variably spaced from one another when the left and right gripper arms are rotated about the pivot axis; a spring for biasing the left and right gripper arms toward a closed position by applying a spring force to left and right gripper arms; and a base portion formed from left and right legs that each have a bottom end and a top end, the top ends of the left and rights legs pivotally connected to one another about the pivot axis and extending integrally downward from the left and right gripper arms, respectively, the left and right legs expanding outward perpendicularly from the pivot axis to create a leg-to-leg distance of variable width between a bottom end of the first and second legs, and the bottom ends of the legs each having surface contact portion of fixed depth along a depth that is parallel to the pivot axis. Uniquely, the sponge contact portions at the top ends of the left and right gripper arms collectively defining a sponge-gripping gap between the top ends of the left and right gripper arms that is wider in the central area than near the front or rear areas of the gripper arms so that the beauty sponge is held without formation of a fold line.

In other embodiment, the beauty sponge gripper and stand has a leg-to-leg distance of variable width between the bottom end of the first and second legs that is less than a width between the first and second gripper arms when a sponge is being held by the first and second gripper arms so that a user's fingers can freely extend past the relatively narrow base portion and comfortably hold the gripper portion. Preferably, the leg-to-leg distance of variable width between the bottom end of the first and second legs is about the same as a width between the first and second gripper arms when no sponge is being held by the first and second gripper arms.

In addition, the fixed depth of the surface contact portions of the left and right legs is preferably wider than the depth of the first and right gripper arms to increase the stability of the base portion.

The preferred beauty sponge gripper has C-shaped cutouts at the top end of left and right gripper arms that are equipped with first and second rubber grips that engage the C-shaped cutouts and provide a plurality of ribs for increased gripping of the beauty sponge.

BRIEF DESCRIPTION OF THE DRAWINGS

The just summarized invention is best understood with referenced to the drawings of which.

DETAILED DESCRIPTION OF THE PREFERRED EMBODIMENTS

In order to resolve the above problems associated with directly gripping a beauty sponge, and having to set it down when not in use and for drying, all of which leads to undesirable soiling of fingers and other surfaces with makeup, I have developed a beauty sponge gripper and stand 10 that offers the following unique features:

Gives better control of sponge during application

Easier to grip during application

Figure 1:
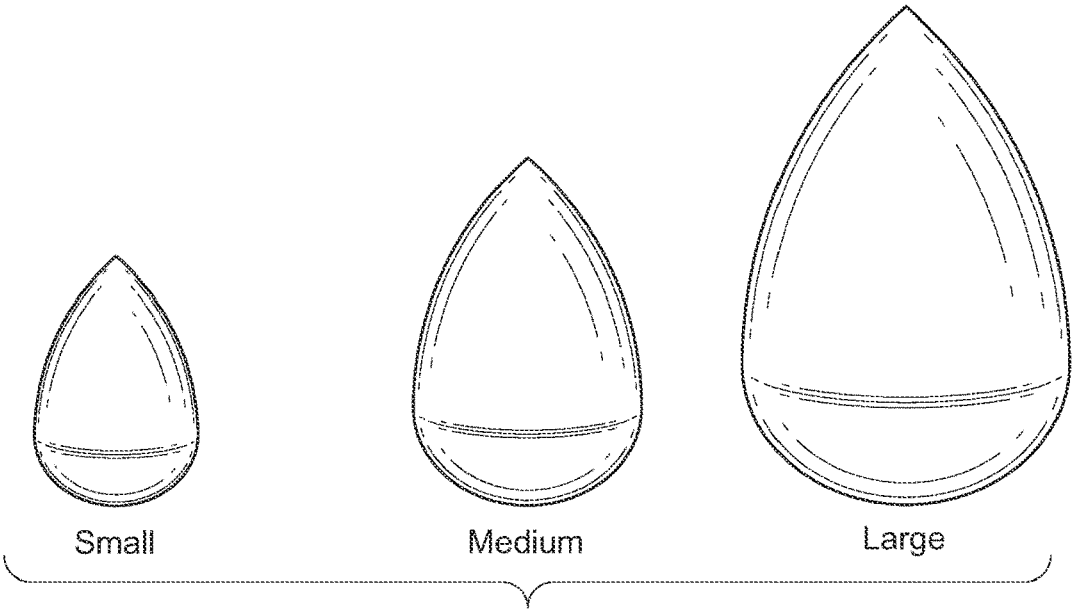
FIG. 1 shows several egg-shaped sponges which sometimes come in small (about ¾" in width), medium (about 1" in width), and large (about 1½" in width)
Figure 2:
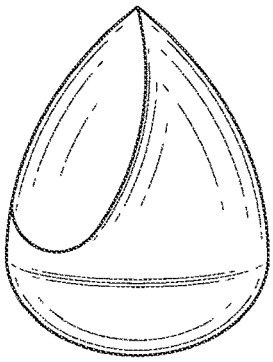
FIG. 2 shows an egg-shaped sponge with a bevel.
Figure 3:
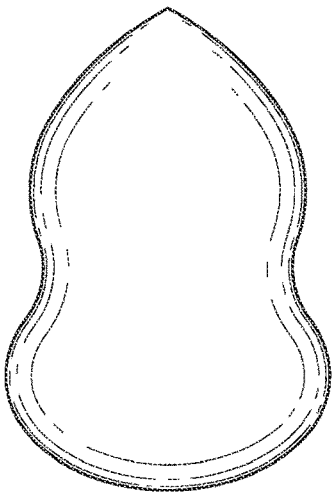
FIG. 3 shows an egg-shaped sponge with a bulbous base.
Figure 4:
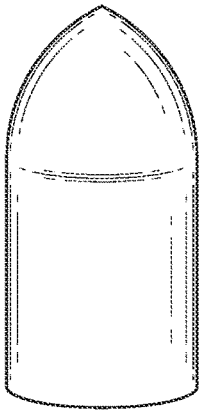
FIG. 4 shows a bullet-shaped sponge.
Figure 5:
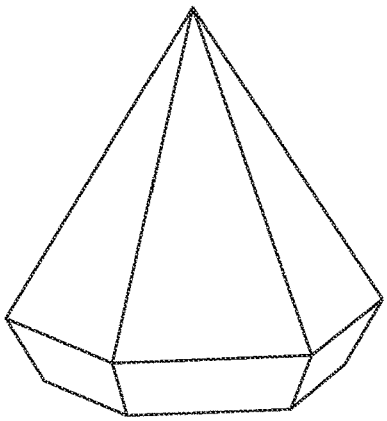
FIG. 5 shows a multi-faceted sponge.
Figure 6:
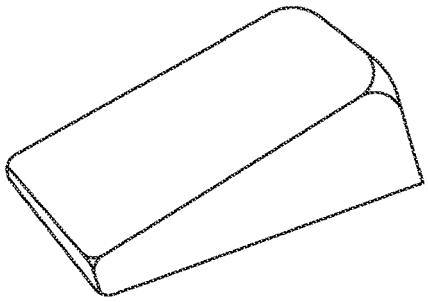
FIG. 6 shows a wedge-shaped sponge.
Figure 7:
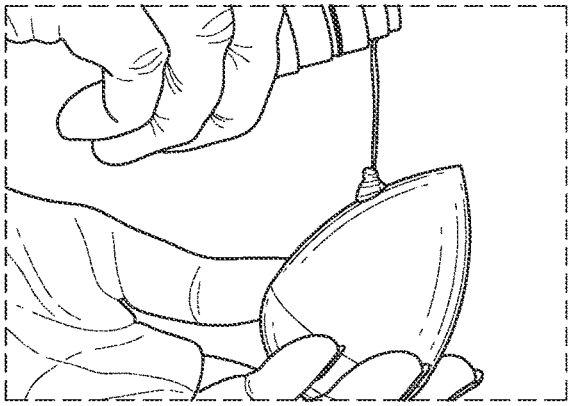
FIG. 7 shows the sponge being held directly with the user's fingers and the makeup of choice being poured onto the sponge.
Figure 8:
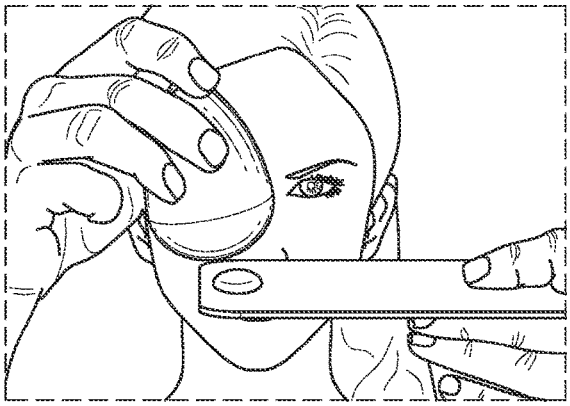
FIG. 8 shows the sponge being held directly with the user's fingers and dipped into the makeup of choice.
Figure 9:
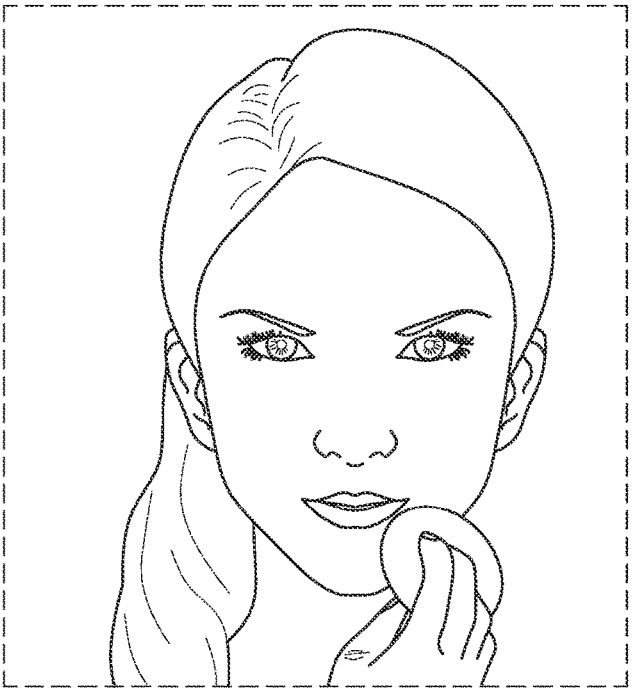
FIG. 9 shows the beauty sponge being held directly with a user's fingers and being used to stipple, dab and/or blend makeup onto the user's face.
Figure 10:
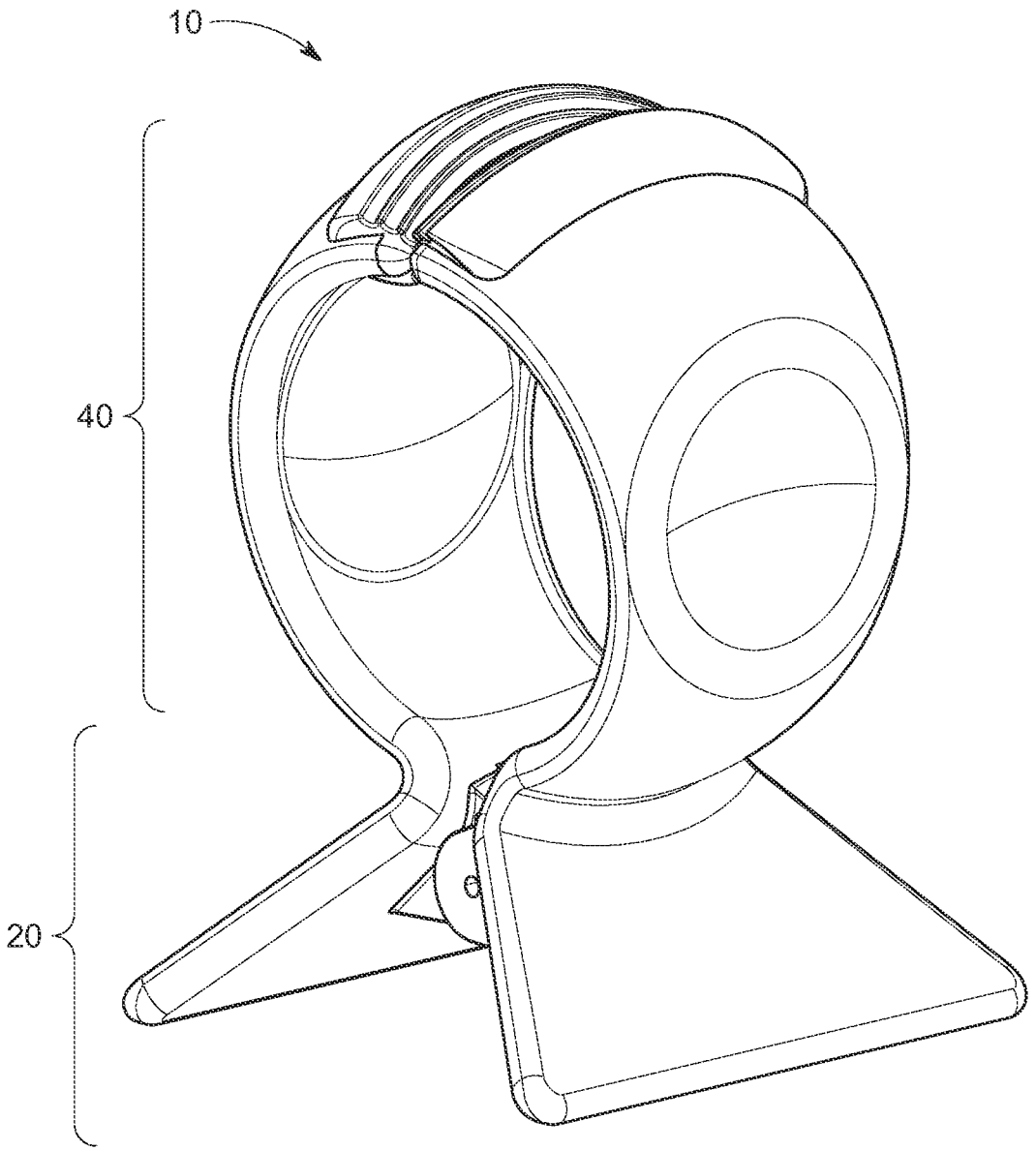
FIG. 10 shows a first preferred embodiment of a beauty sponge gripper and stand 10—here resting on a flat surface but without a sponge—having a base portion 20 and gripper portion 40 for receiving a beauty sponge.

Eliminates dirty fingers and nails during application
Self-standing even when gripping a wet sponge
Can be used as a drying stand for wet sponge
Does not damage the sponge
Can grip many different size and shapes of sponges
Sanitary, the sponge will not be laid down on a counter or surface since it has its own stand
Can be disinfected FIG. 10 shows a first preferred beauty sponge gripper and stand 10 according to a first embodiment of the present invention. As shown, the preferred beauty sponge gripper and stand 10 generally comprises a base portion 20 that reliably rests on a flat surface, and a gripper portion 40 that is specially designed to grip a beauty sponge of varying size or shape without damaging it. The base portion 20 allows the user to insert a sponge into the gripper portion 40 to form a gripper/sponge assembly that can be set on the countertop when briefly not in use and also for long-term drying of the beauty sponge without having to remove it from the gripper 10.

Figure 11A:
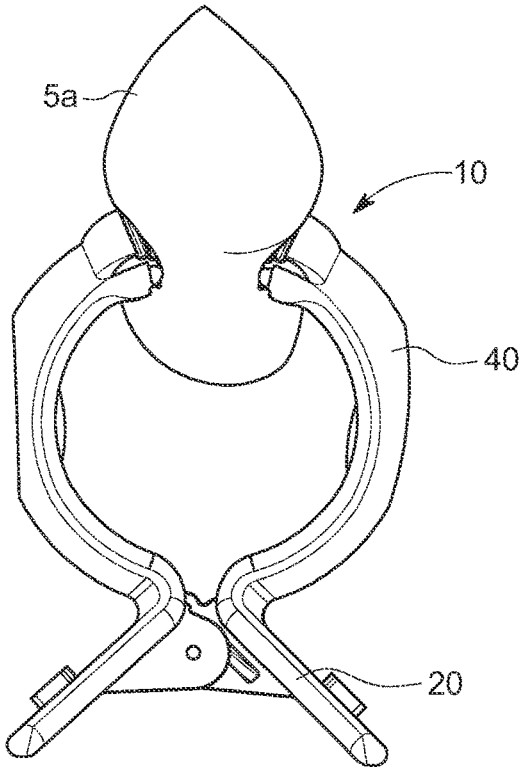
FIGS. 11*a*, 11*b*, and 11*c* show the beauty sponge gripper and stand 10 being used to grip a small beauty sponge 5*a*, medium beauty sponge 5*b*, and large beauty sponge 5*c*, respectively, with the user's thumb and index finger extending past the relatively narrow base portion 20 to firmly hold and if desired further squeeze the gripper portion 40—with the user able to control the sponge 5*a*, 5*b* or 5*c* without the user having to make direct physical contact with the sponge.
Figure 11B:
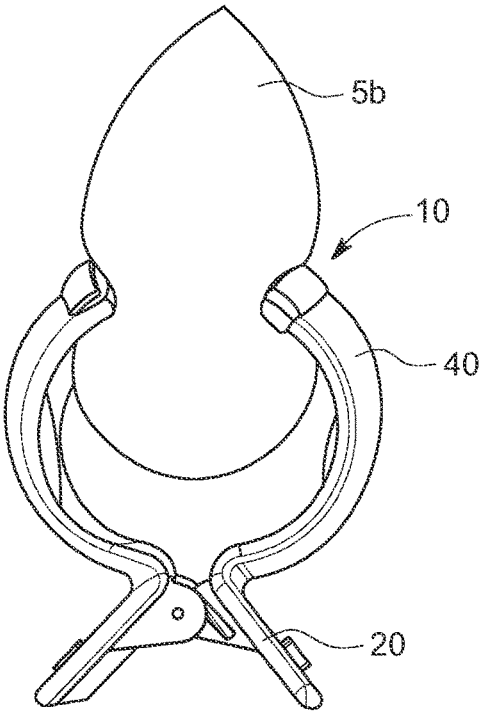
Figure 11C:
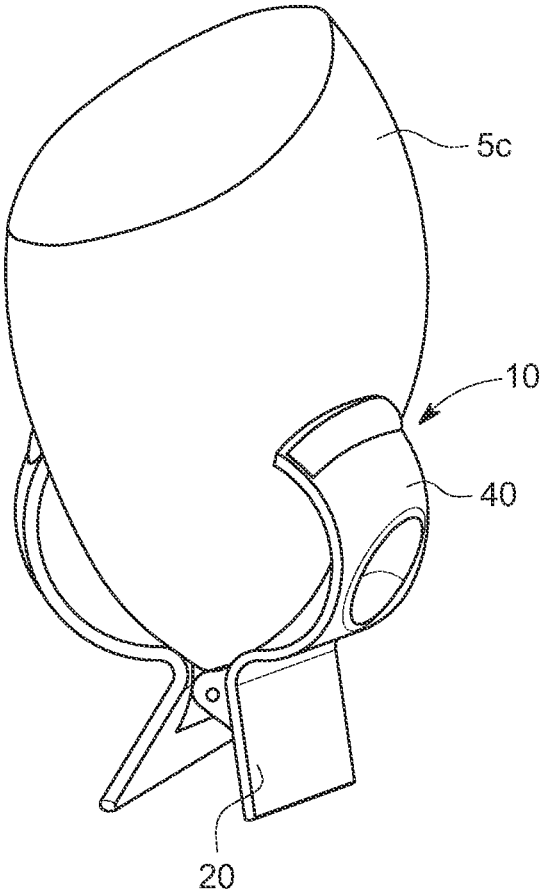
Figure 12A:
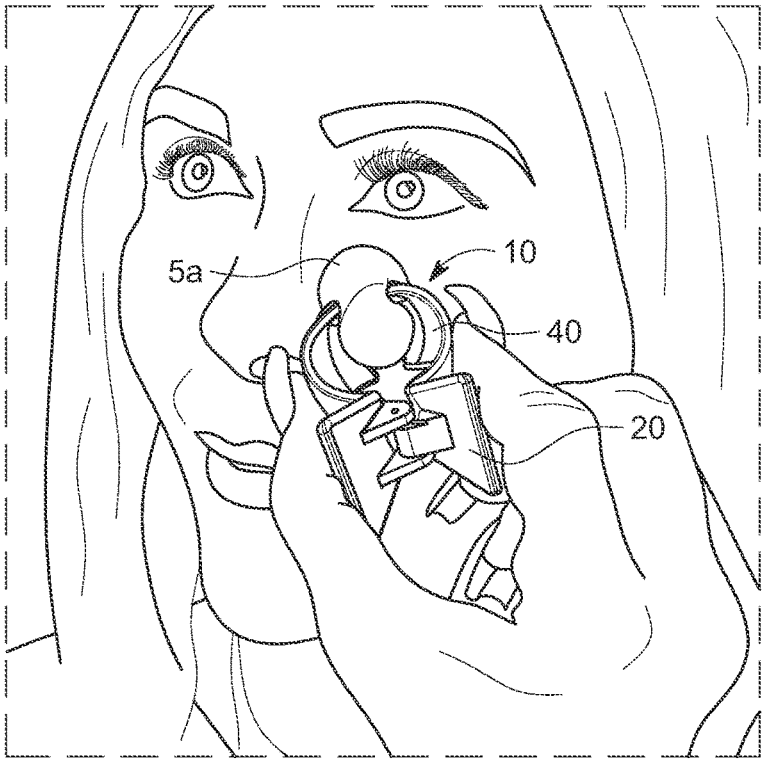
FIGS. 12*a*, 12*b*, and 12*c* show a woman applying makeup with a small, medium and large beauty sponge 5*a*, 5*b*, and 5*c*, respectively, by using her thumb and index finger to hold the gripper portion 40 of the beauty sponge gripper 10 which, in turn, holds the corresponding beauty sponge as it is dabbed against her skin.

FIGS. 11*a*, 11*b*, and 11*c* show the beauty sponge gripper and stand 10 being used to grip various sized beauty sponges, here a small beauty sponge 5*a* (egg-shaped with a point), medium beauty sponge 5*b* (egg-shaped with a point), and large beauty sponge 5*c* (egg-shaped with an application bevel). Notably, in all three cases, the width of the base portion 20 running perpendicular to the hinge is narrower than the width of the gripper portion 40 so that the user's thumb and index finger can freely extend past the relatively narrow base portion 20 and comfortably hold the gripper portion 40. As suggested by FIGS. 12*a*, 12*b*, and 12*c*, the relative narrow size of the base portion 20 allows the user to firmly grasp the gripper 10 and easily control the movement of the sponge 5*a*, 5*b* or 5*c*, further squeezing the gripper portion 40 if desired, and ultimately apply less or more pressure from sponge to skin as desired, all without having to make direct physical contact with the sponge.

Figure 13:
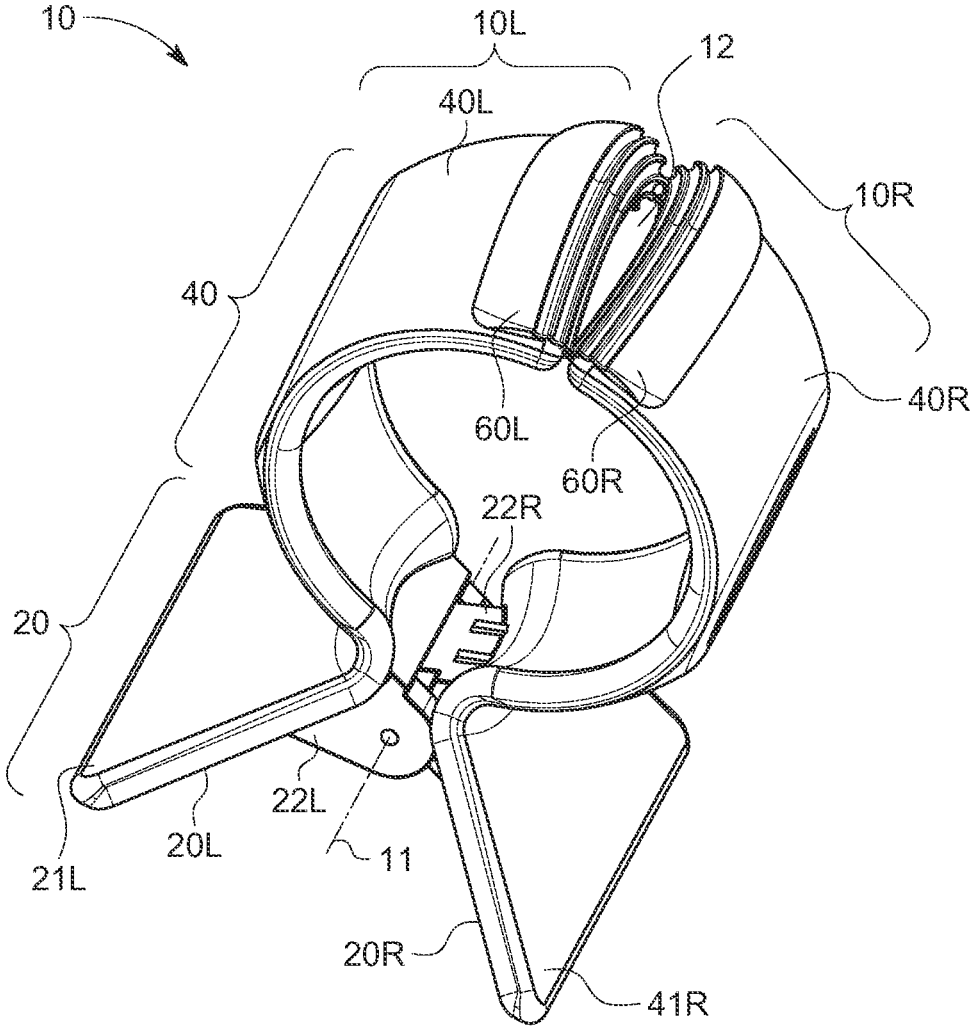
FIG. 13 it a top perspective view of the first preferred beauty sponge gripper and stand 10, showing its components and, in particular, a curved center gap 12 that is defined between curved rubber grips 60L, 60R.

FIG. 13 it a top perspective view of the first preferred beauty sponge gripper and stand 10, showing its components in more detail and, in particular, its unique curved center gap 12 that is defined between curved rubber grips 60L, and 60R. In the presently preferred embodiment, the gap 12 is about 2.3 mm across at the widest, center-most position, and the rubber grips 60L, 60R themselves are about 23 mm wide, such that the gap-to-depth ratio of about 1:5 to about 1:10 is preferred. It is believed that this ratio results in a firm, non-damaging grip of the beauty sponge, preventing any detrimental hinge-like behavior at a fold line that may develop from being squeezed too aggressively, and allowing the internal integrity of the beauty sponge to move, relatively unaffected through the gap 12. However, narrower gap-to-depth ratios of about 1:20 are possible, and wider gap-to-depth ratios of even 1:1 (full circle) are possible as well.

As shown, the preferred beauty sponge gripper and stand 10 is formed from two cooperating halves 10L, 10R that pivotally interconnect with one another around a pivot axis 11 which receive a suitable pin (not separately numbered). Each pivoting half 10L, 10R further contains a base portion half (20L, 20R) located below the pivot axis 11 and a gripper portion half (40L, 40R) located above the pivot axis 11. The base portions 20L, 20R further include pivot projections 22L, 22R that contains apertures and cooperatively engage one another in a male/female fashion to define the pivot axis 11. Thus, when the two cooperating halves 10L, 10R are assembled via pivot projections 22L, 22R, which define the pivot axis 11, the base portion 20 is formed from the two halves 20L, 20R and the gripper portion 40 extending upward from the base portion 20 is formed from the two halves 40L, 40R.

As further shown in FIG. 13, the curved rubber grips 60L, 60R define a center mouth gap 12 that allows the beauty sponge gripper and stand 10 to securely support a wide variety of beauty sponges without damaging them. The inventor believes that the center mouth gap 12 imposes less compression on the center of the beauty sponge so that the sponge itself meters the maximum possible compression across its depth, and so that the contact zone does not form a deep, line-shaped compression zone (folding line) that detrimentally acts like a hinge and allows the beauty sponge to uncontrollably wiggle back and forth to some degree when in use.

Figure 14:
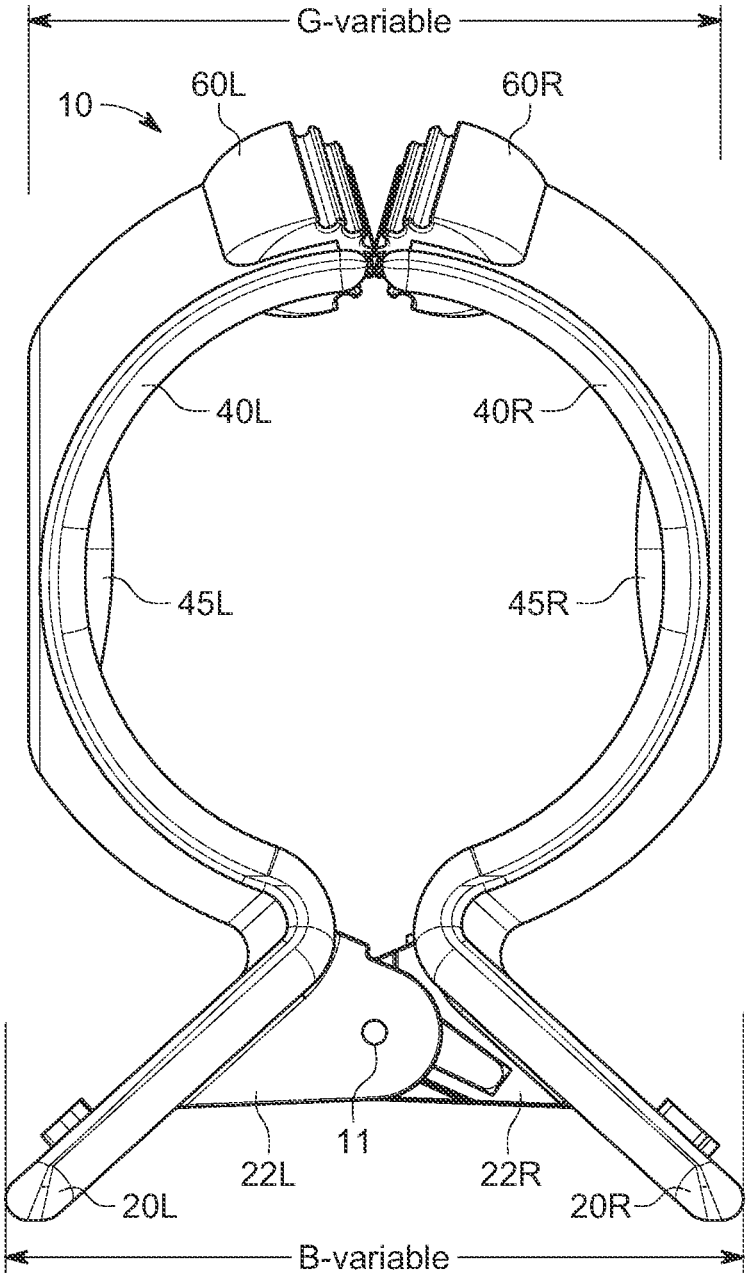
FIG. 14 is a front elevational view of the first preferred beauty sponge gripper and stand 10 in a closed position, with no sponge, showing how a variable width "B" of the base portion 20 is substantially the same as a variable width G of the gripper portion 40 when no sponge is present.

FIG. 14 is a front elevational view of the first preferred beauty sponge gripper and stand 10 a closed position, with no sponge, showing how a variable width "B-variable" of the base portion 20 is substantially the same as a variable width "G-variable" of the gripper portion 40 when no sponge is present. Of significance, however, when the user squeezes the base portion halves 20L, 20R toward one another, the variable width "B-variable" of the base portion is reduced in size to become smaller widths Ba, Bb, Bc and the variable width "G-variable" is increased in size to become larger widths Ga, Gb, Gc, both as a function of the sponge size, as shown in FIGS. 15*a*, 15*b*, and 15*c*, respectively.

Figure 12B:
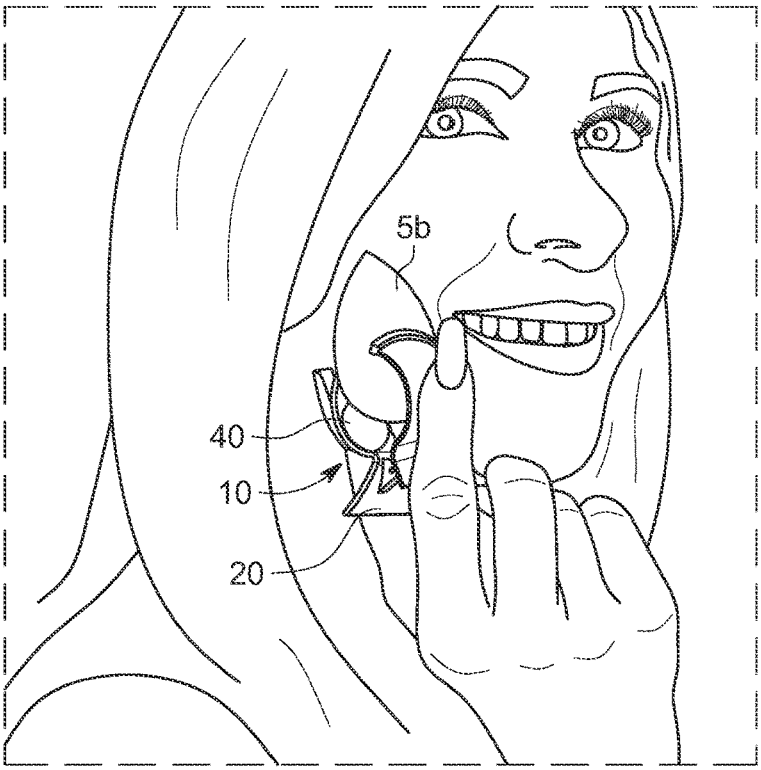
Figure 12C:
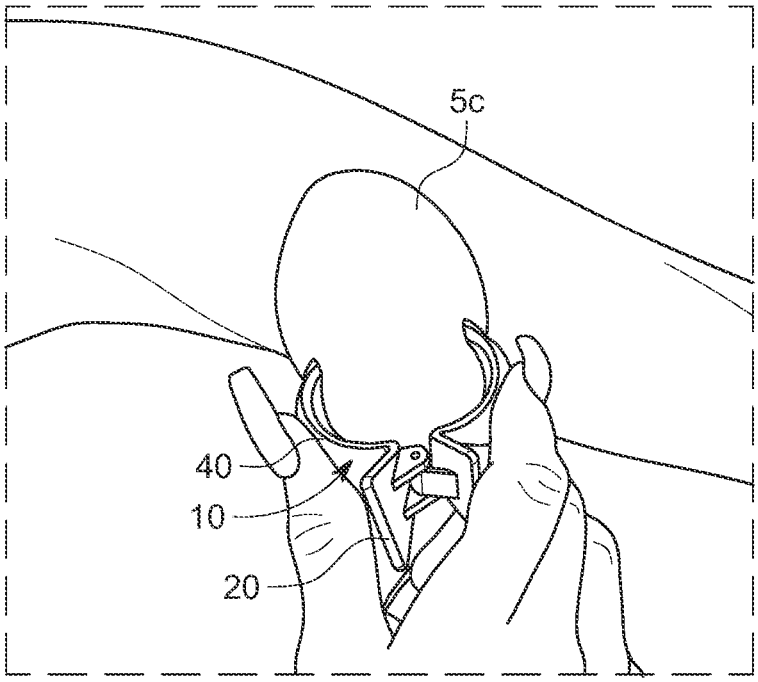
Figure 15A:
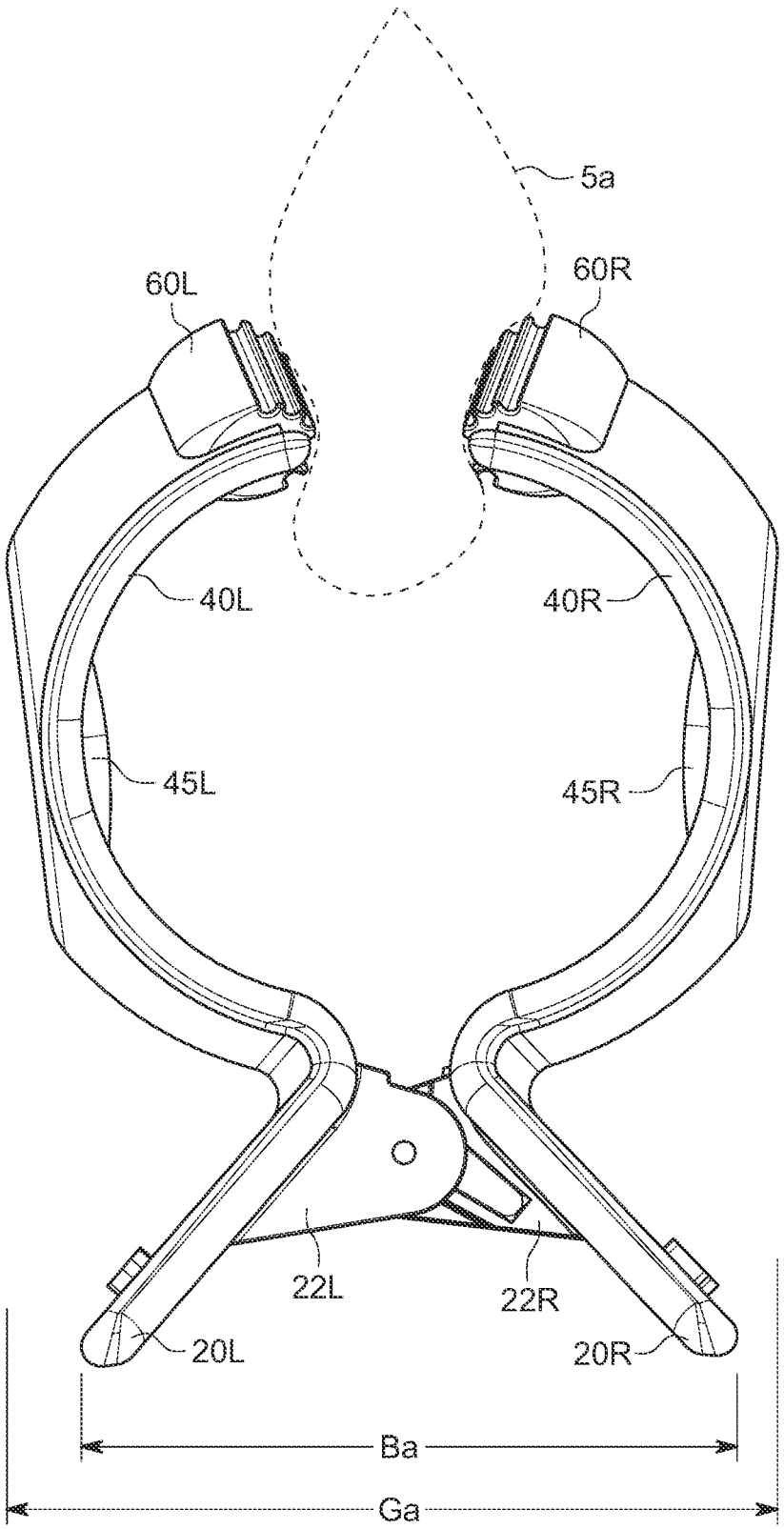
FIGS. 15*a*, 15*b*, and 15*c* are front elevational views of the first preferred beauty sponge gripper and stand 10 in a closed position while holding (i.e. squeezing) a small, medium and large beauty sponge 5*a*, 5*b*, and 5*c*, respectively, showing how the variable width "B" of the base portion 20 is in all cases less than the variable width G of the gripper portion 40 when a sponge is present so that when the gripper 10 is holding a sponge the user's fingers can extend unobstructed past the base portion 20 and rest on opposite sides of the gripper portion 40 as shown in FIGS. 11*b*, 12*b*, and 13*b;*
Figure 15B:
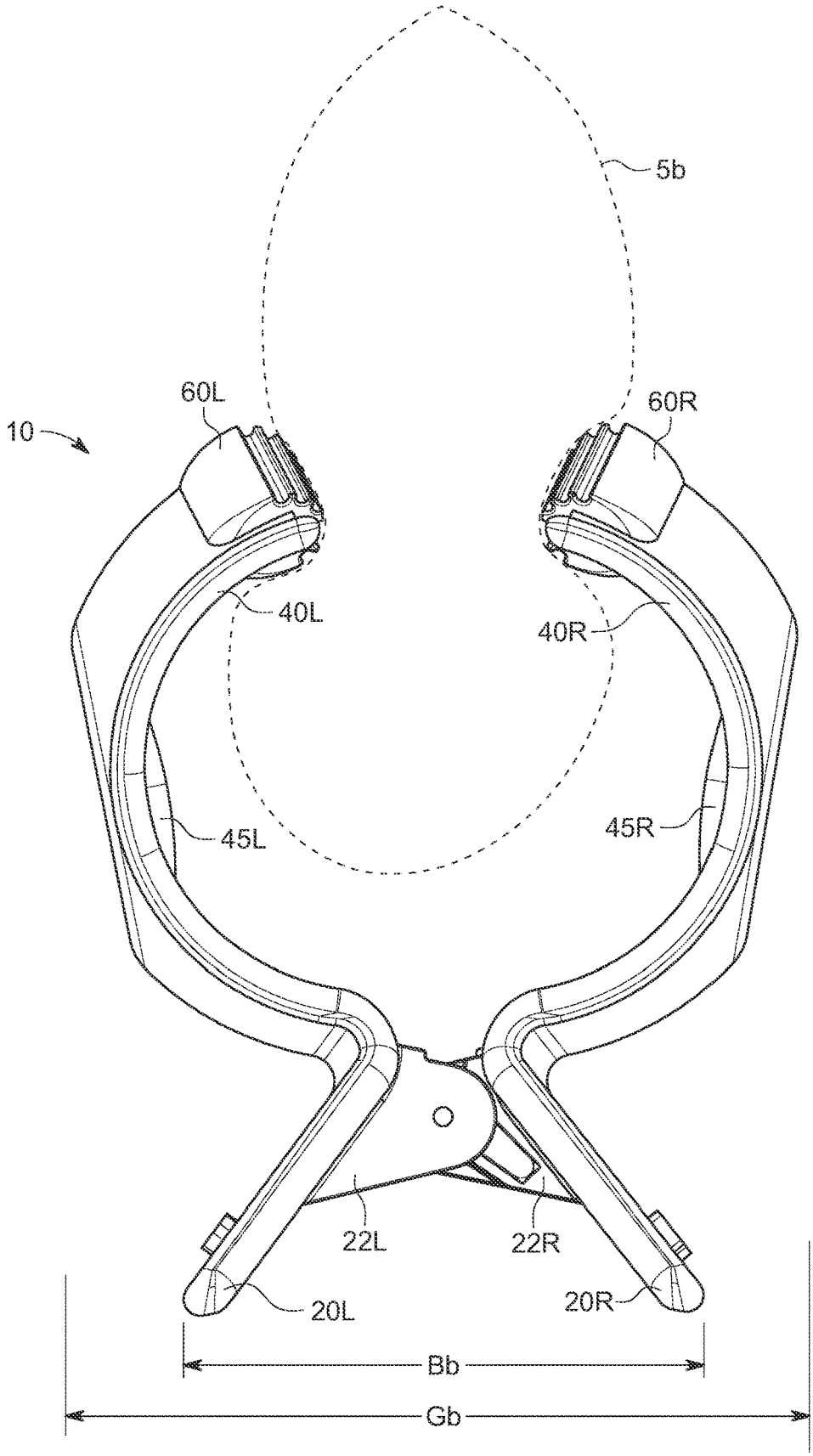
Figure 15C:
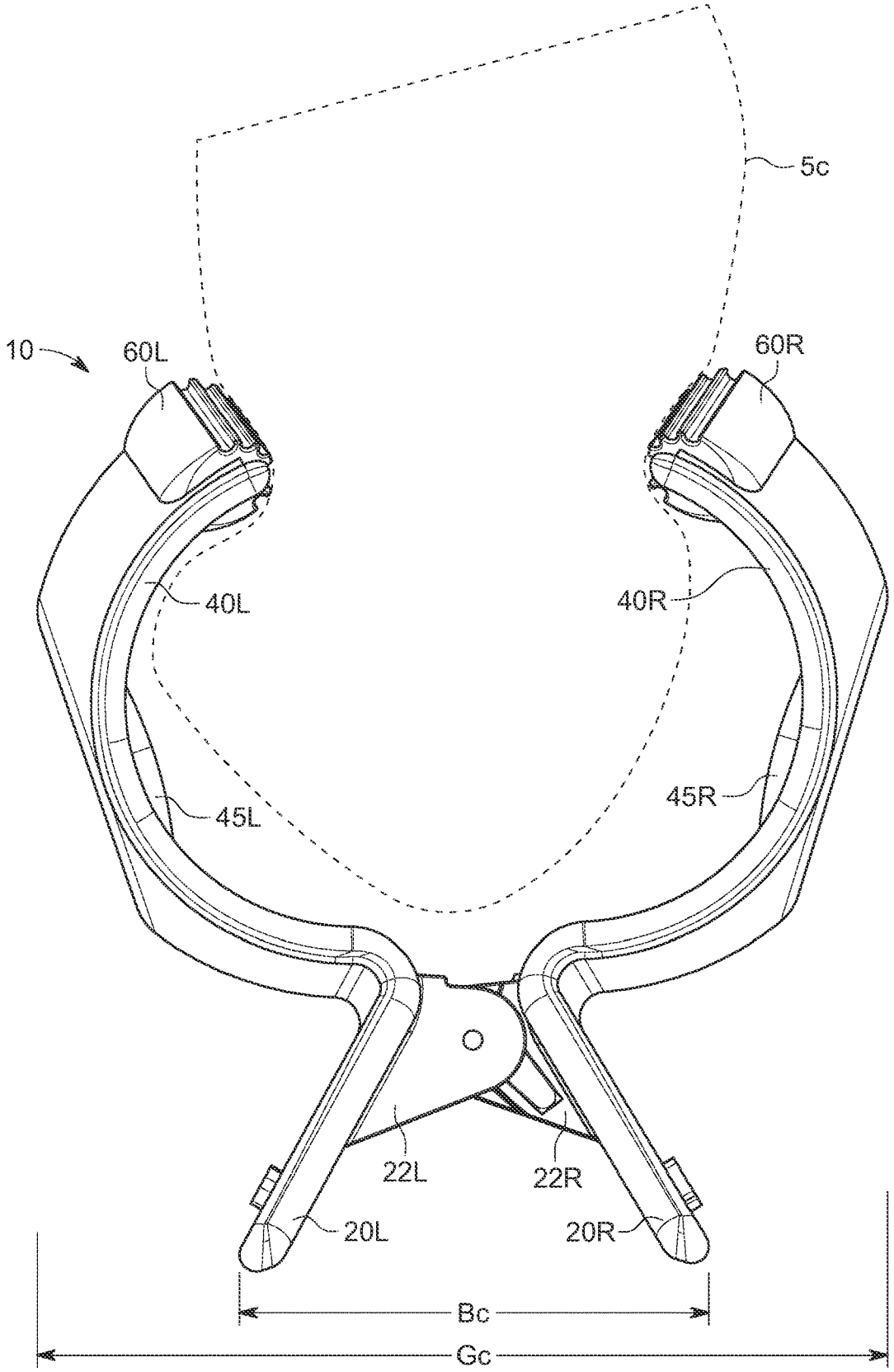

FIGS. 15*a*, 15*b*, and 15*c*, mentioned above, are front elevational views of the first preferred beauty sponge gripper and stand 10 in a semi-closed position while holding (squeezing down on) a small, medium and large beauty sponge 5*a*, 5*b*, and 5*c*, respectively, showing how the variable width "B-variable" of the base portion 20 is reduced to smaller widths Ba, Bb, and Bc which is in all cases less than the variable width G-variable of the gripper portion 40 which is increased to greater widths Ga, Gb, and Gc. This dimensional relationship allows the user's fingers to extend unobstructed past the base portion 20 and rest on opposite sides 40L, 40R of the gripper portion 40 when the gripper 10 is holding a sponge, as shown in FIGS. 11*b*, 12*b*, and 13*b*, ideally in finger wells 45L, 45R. Of significance, the base portion halves 20L, 20R provide a wide footing in the perpendicular dimension (see B-fixed in FIG. 19) so that the overall base portion 20 forms a solid, stable base when the gripper and stand 10 is rested on the countertop, even when holding a sponge.

Figure 16:
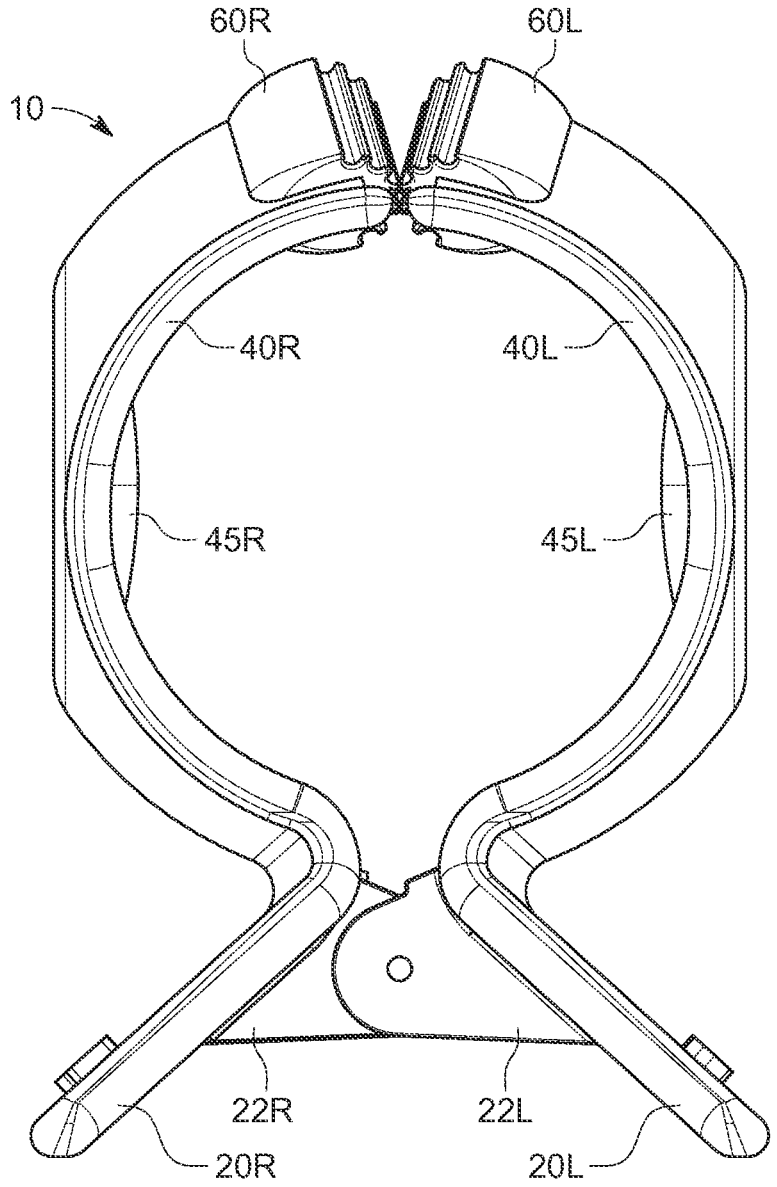
FIG. 16 is a back elevational view of the first preferred beauty sponge gripper and stand 10 of FIG. 13.

FIG. 16 is a back elevational view of the first preferred beauty sponge gripper and stand 10 of FIG. 13. This view is essentially a mirror image of the front view of FIG. 14*s*.

Figure 17:
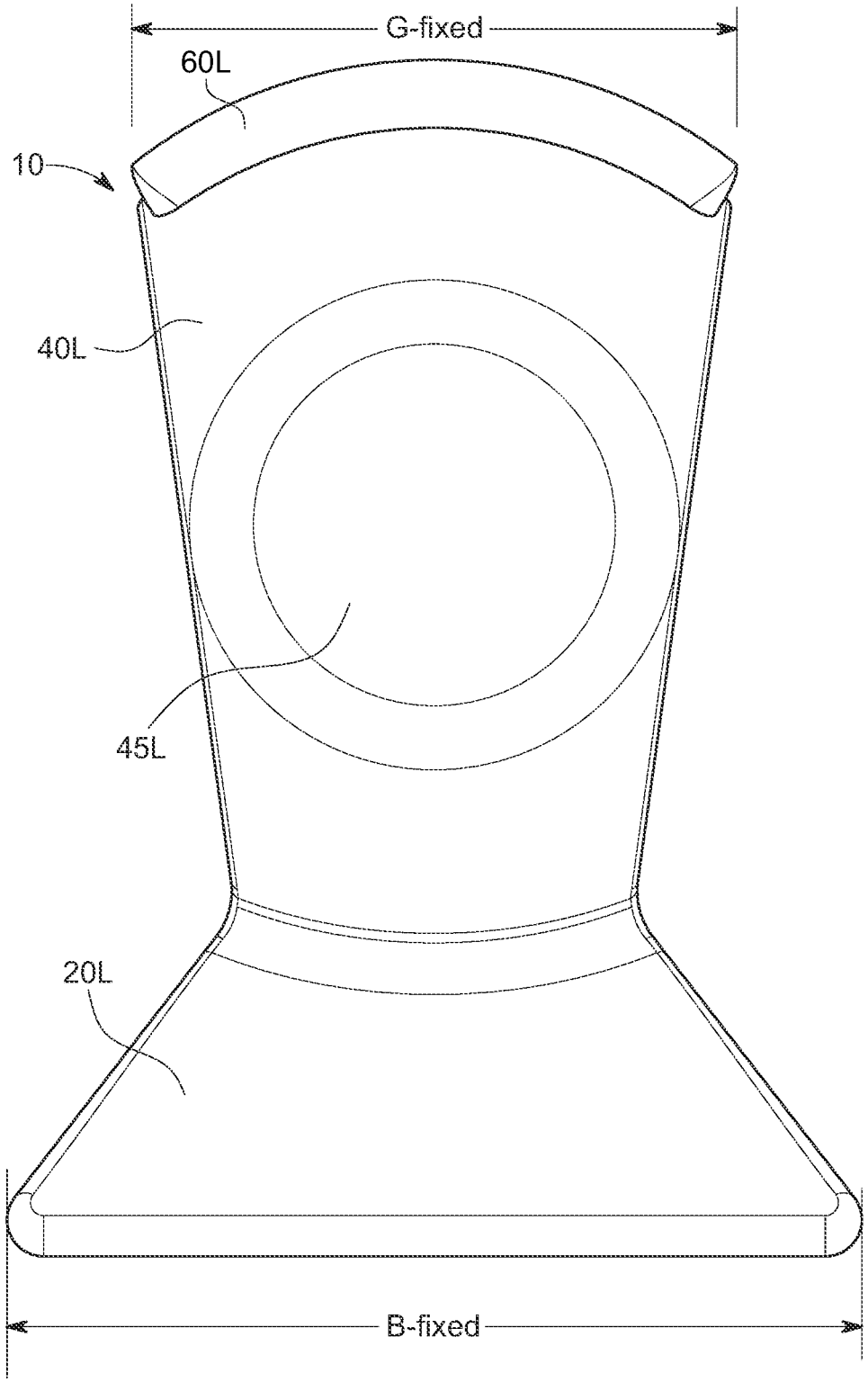
FIG. 17 is a left elevational view of the first preferred beauty sponge gripper and stand 10.
Figure 18:
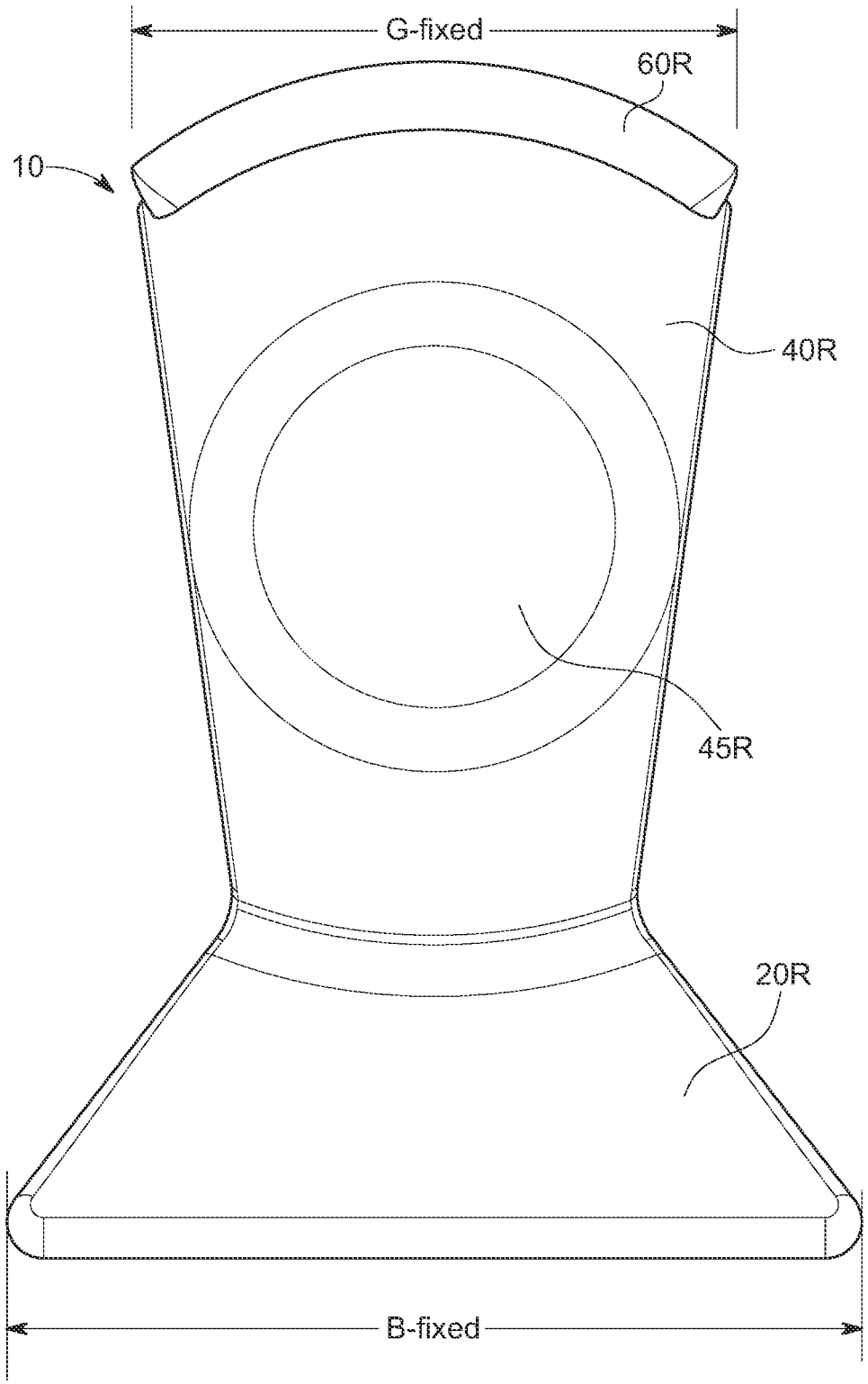
FIG. 18 is a right elevational view of the first preferred beauty sponge gripper and stand 10.

FIGS. 17 and 18 are left and right elevational views of the first preferred beauty sponge gripper and stand 10. These two views best show the finger wells 45L, 45R that suggest the user should hold beauty sponge holder and stand 10 from these two sides, and that when so held, receive the user's fingers for enhanced control of the beauty sponge. FIGS. 17 and 18 also show how, when viewed from the left and right sides, the gripper portion has a fixed depth "G-fixed" and the base portion 20 has a fixed depth "B-fixed" that is substantially greater in depth. Making B-fixed greater than G-fixed helps the base portion 20 provide a stable platform when the beauty sponge gripper and stand 10 is being used as a stand.

Figure 19:
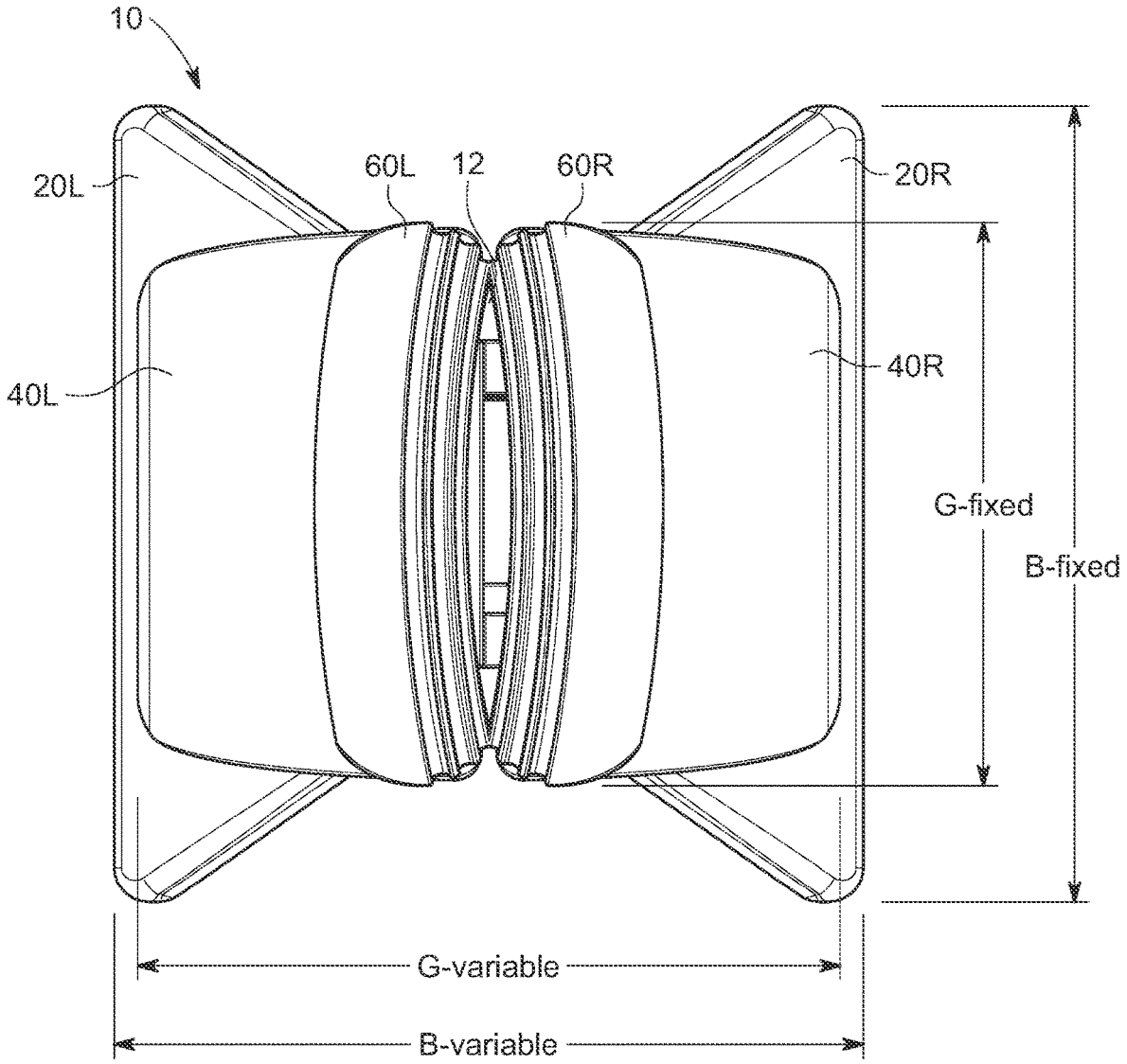
FIG. 19 is a top view of the first preferred beauty sponge gripper and stand 10.

FIG. 19 is a top view of the first preferred beauty sponge gripper and stand 10. From this perspective, one can simultaneously see the dimensional relationship between the base portion 20 and the gripper portion 40 in this first preferred embodiment, i.e. the variable widths B-variable and G-variable and the fixed depths B-fixed and G-fixed. Also shown here, from above, is the unique gap 12 which allows the beauty sponge gripper and stand 10 to firmly grip a beauty sponge without damaging it.

Figure 20:
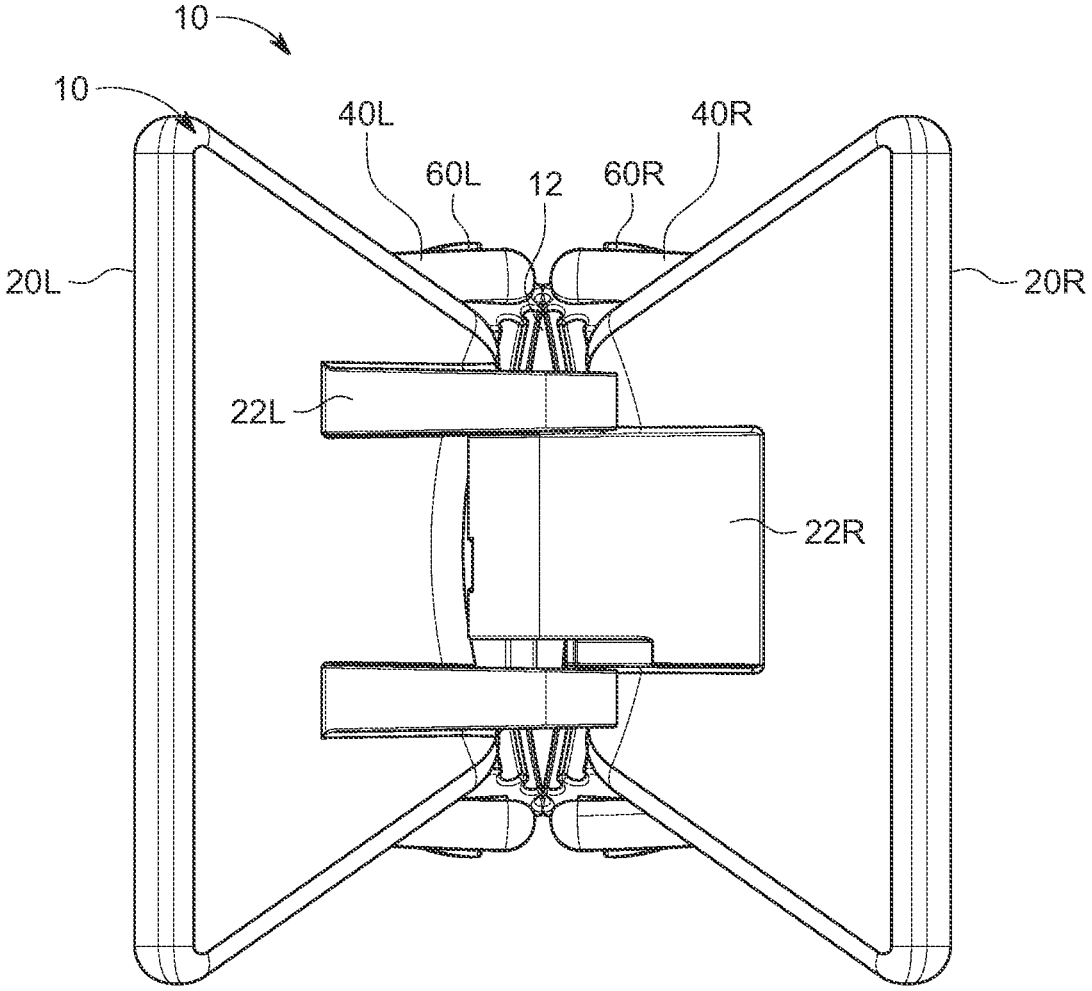
FIG. 20 is a bottom view of the first preferred beauty sponge gripper and stand 10.

FIG. 20 is a bottom view of the first preferred beauty sponge gripper and stand 10. This view most clearly shows the nesting relationship between the pivot projections 22L, 22R that cooperatively engage one another to define the pivot axis 11 shown in FIG. 13. Although not shown, it can be appreciated that a small coil spring 25 (see FIG. 23) would be captured between the pivot projections 22L, 22R in order to bias the gripper portion halves 40L, 40R toward the closed position.

Figure 21:
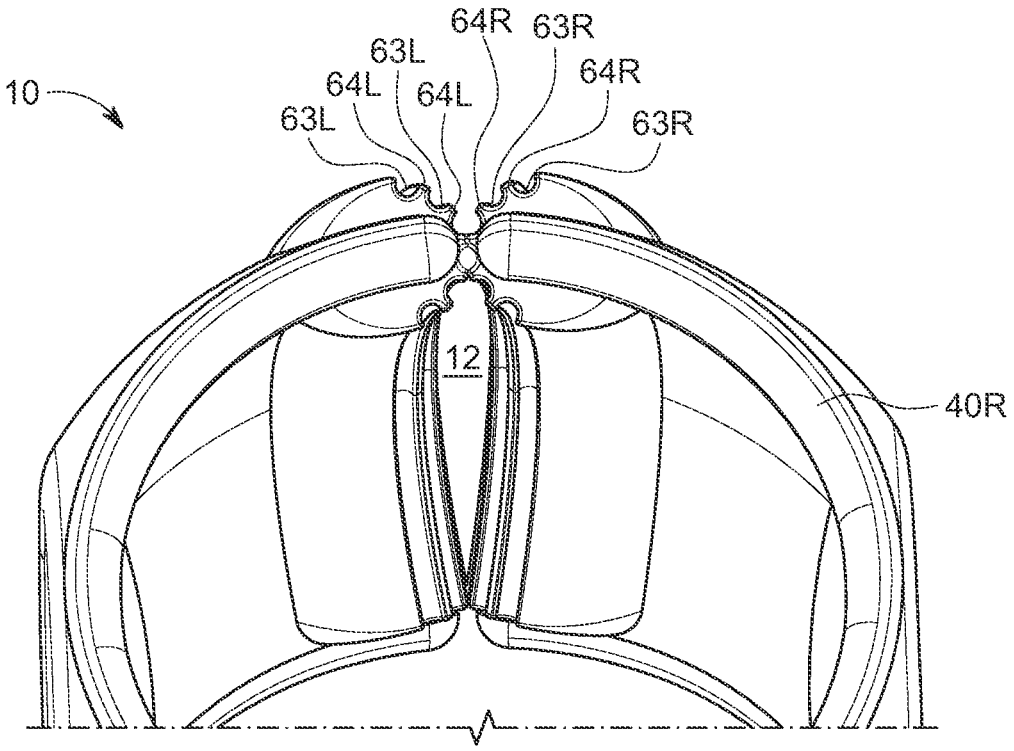
FIG. 21 is a closeup view, from the underside, of the rubber grips 60L, 60R.

FIG. 21 is a closeup view, from the underside, of the rubber grips 60L, 60R. As shown, a gap 12 exists even when the gripper portion halves 40L, 40R and corresponding rubber grippers 60L, 60R are in the fully closed position. This geometry allows the beauty sponge gripper and stand 10 to firmly grip various sized beauty sponges without damaging them, even when stored in the stand 10 for long-term drying. The preferred rubber grips 60L, 60R have a plurality of elongated grooves 63L, 63R which define a plurality of elongated ribs 64L, 64R that resiliently press against a beauty sponge held between the rubber grips.

Figure 22:
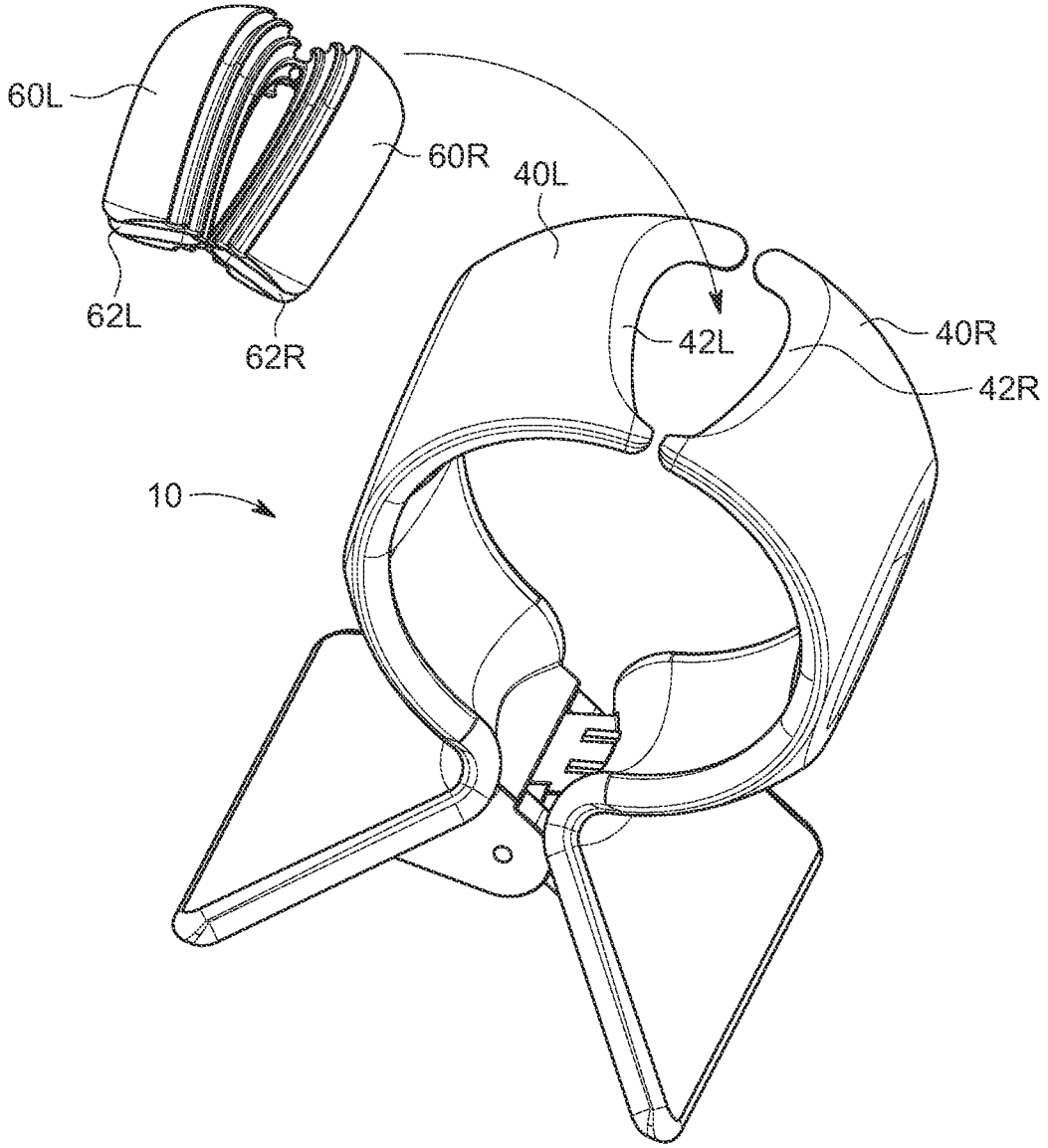
FIG. 22 is an exploded perspective view showing how the rubber grips 60L, 60R mate with the pivoting halves 10L, 10R.

FIG. 22 is an exploded perspective view showing how the rubber grips 60L, 60R mate with the pivoting halves 10L, 10R. In particular, as shown, each of the gripper portion halves 40L, 40R has a C-shaped end 42L, 42R and each of the rubber grips 60L, 60R has a groove 62L, 62R that mates with a corresponding C-shaped end 42L, 42R. The connection can be provided with a friction-fit arrangement, a suitable adhesive, or both.

Figure 23:
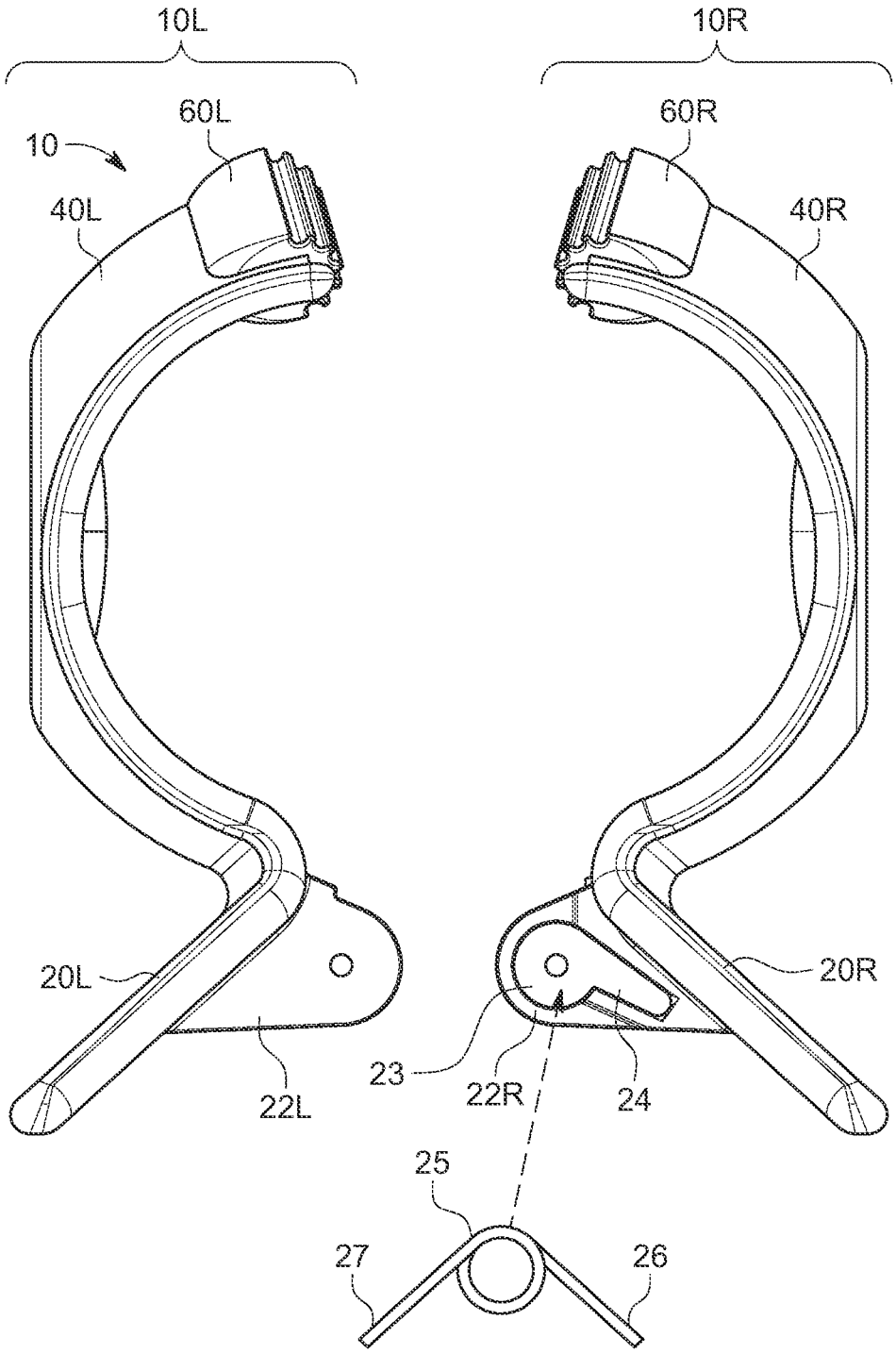
FIG. 23 is a front elevational view of the pivoting halves 10L, 10R separate from one another.

FIG. 23 is a front elevational view of the pivoting halves 10L, 10R separated from one another. As shown, the right-side pivot projection 22R includes a spring-well 23 having a tang-catch 24 which allows a coil spring 25 having tangs 26, 27 to bias the gripper portion halves 40L, 40R toward one another. In more detail, the spring's body is received within the spring-well 23, with spring tang 26 is received in the tang-catch 23 in right half 20R, while spring tang 27 presses directly against the left half 20L.

Figure 24:
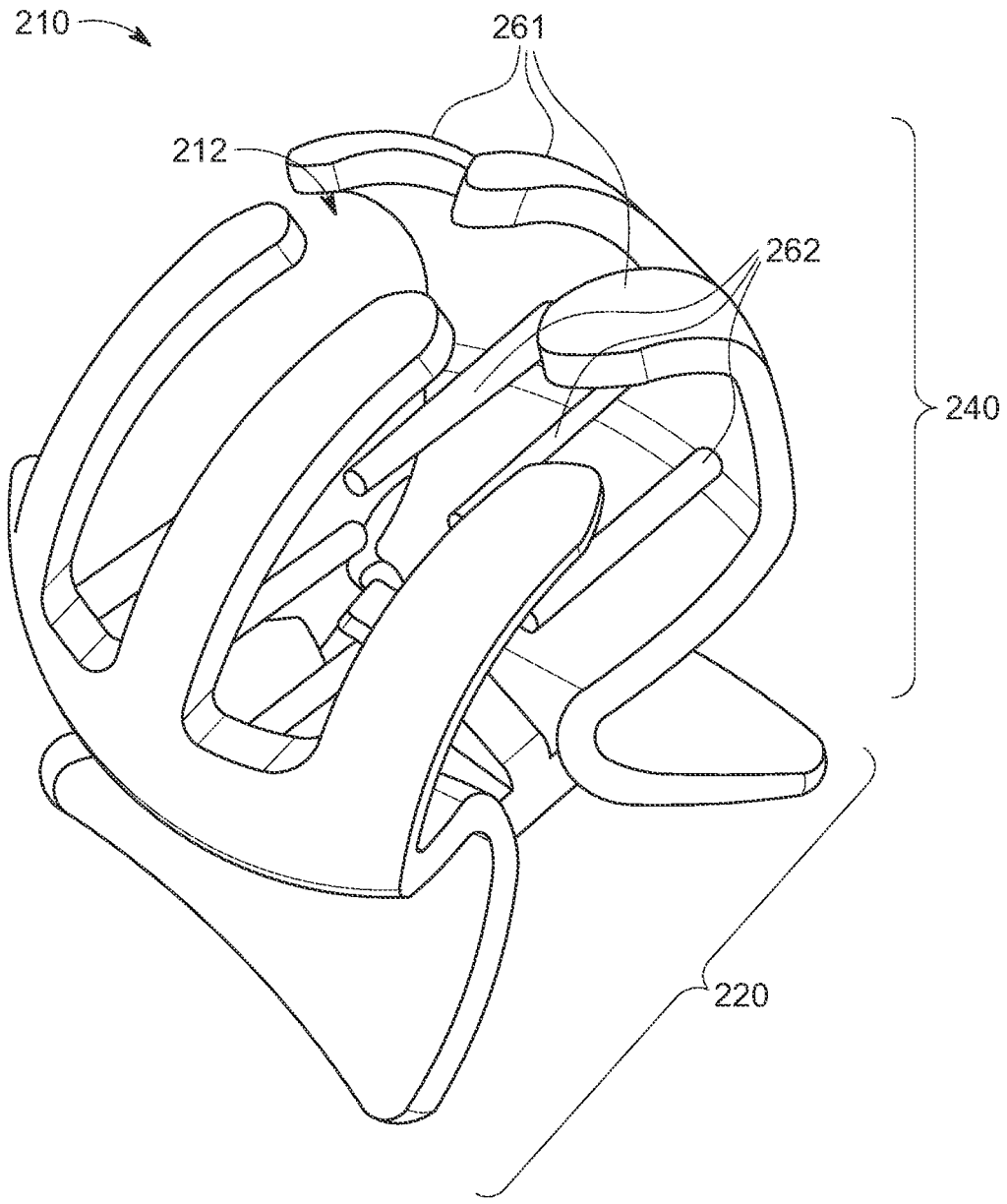
FIG. 24 shows a second alternative embodiment of a beauty sponge gripper and stand 210 having a base portion 220 and gripper portion 240 that, instead of curved rubber grippers that provide continuous contact, has a plurality of discrete fingers 261, 262 of varying length that, even though offset, suitably define a center gap 212 for receiving and holding a beauty sponge.

FIG. 24 shows a second alternative embodiment of a beauty sponge gripper and stand 210 having a base portion 220 and gripper portion 240 that, instead of having curved rubber grips 60L, 60R that provide continuous contact, has a plurality of discrete teeth 261 of varying length that, even though offset from one another, suitably define a center gap 212 for receiving and holding a beauty sponge.

The beauty sponge gripper and stand 210 according to this second embodiment offers additional unique features:x

- Pointed teeth with rounded tips to grip the sponge without making holes in the sponge
- The teeth are offset for a solid grip (though they may also be aligned)
- The teeth 261 do not touch or overlap each other. The outer teeth 261 are longer than the center teeth 261 so there is more space in the center than the edges to define the center gap 212, i.e. so it will grip the sponge without squishing it too hard.
- There is optionally a second row of small teeth 262 halfway down, with the same characteristics as the large teeth 261 but much smaller. The small lower teeth 262 help grip the lower end of rectangle, triangle and square sponges and other odd shape sponges.
- The fixed depth sides of the base portion 220, as with the first embodiment, is wider than griper portion 240, when viewed toward the face over which the user's fingers do not extend to make it steady even when holding a wet sponge or larger sponges
- The variable width sides of the base portion 220 is about the same width as the gripper portion 240 when viewed toward the face over which the user's fingers do extend, but narrower when a sponge is being held, for a comfortable feel in the fingers when holding the gripper 220
- Rounded gripper portion 240 to fit in fingers easily and comfortably
- Spring action to open and close the gripper portion 240

Figure 25:
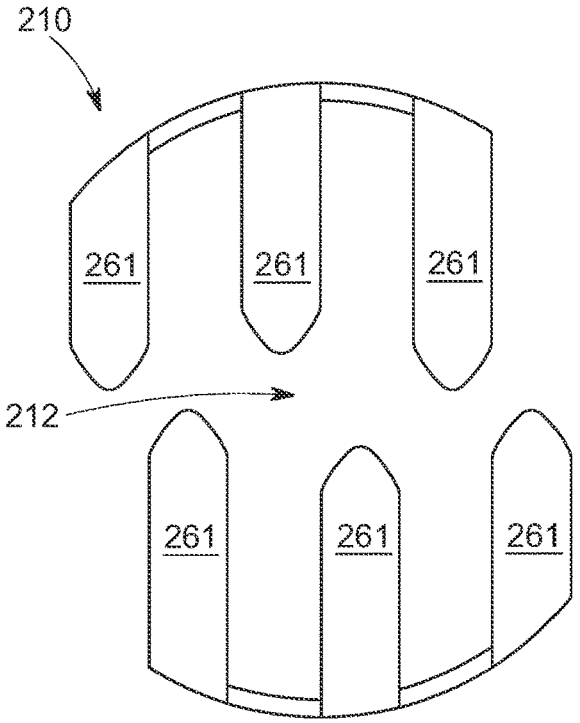
FIG. 25 is a top view of the beauty sponge gripper and stand 210 of FIG. 24.

FIG. 25 is a top view of the beauty sponge gripper and stand 210 of FIG. 24 showing how the teeth 261 are offset or staggered relative to one another, but nonetheless of appropriate length to define the gap 212 for gripping a beauty sponge in a non-damaging manner.

Figure 26:
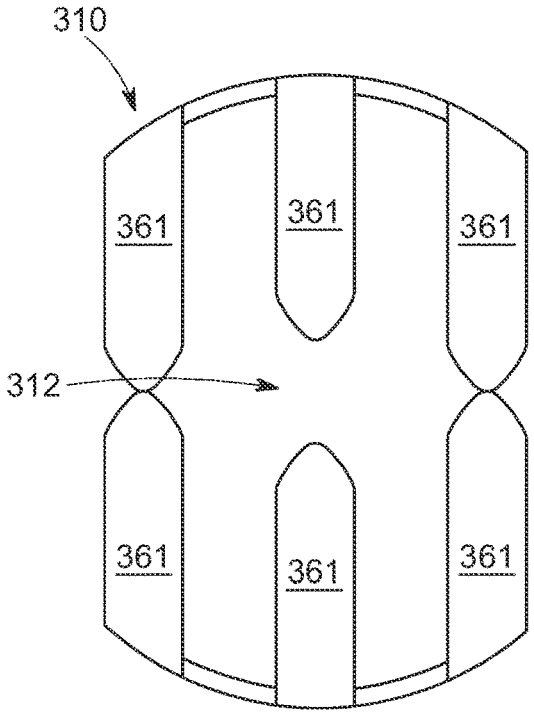
FIG. 26 is a top view of a beauty sponge gripper and stand 310 according to a third alternative embodiment where the fingers 361, 362 are aligned and define a center gap 312 for receiving and holding a beauty sponge.

FIG. 26 is a top view of a beauty sponge gripper and stand 310 according to a third embodiment showing how the teeth 361 may also be aligned, rather than offset, and yet nonetheless be of appropriate length to define a gap 312 for gripping a beauty sponge in a non-damaging manner.

Figure 27:
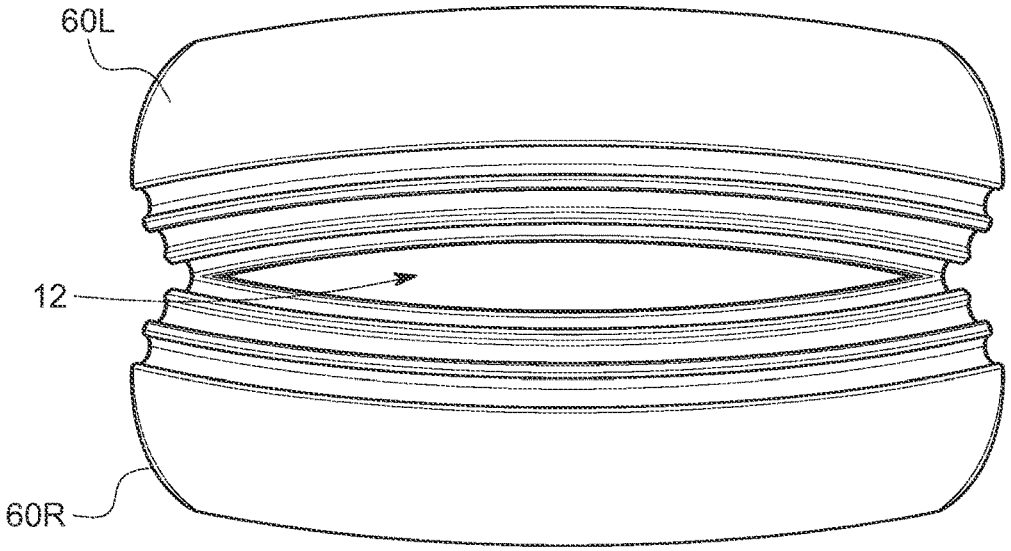
FIG. 27 is a top view of the presently preferred beauty sponge gripper and stand 10 in the same orientation as FIGS. 25 and 26 and showing its corresponding center gap 12.

FIG. 27 is a top view of the presently preferred beauty sponge gripper and stand 10 in the same orientation as FIGS. 25 and 26 so that one can see the correlation between gap 12 and gaps 212 and 312. Numerous other embodiments are possible, whether using full contact grips or discrete contacts based on a finite number of teeth or other arrangement.

I believe that my beauty sponge gripper and stand is completely unique, and have never seen anything like it in the beauty industry.

I claim:

1. A beauty sponge gripper and stand system that is adapted for being held by a user and gripping a beauty sponge for controlled application and blending of makeup that has been applied to the beauty sponge onto the user's face without requiring the user to directly hold the sponge and for supporting the beauty sponge above a countertop without contacting surfaces that would otherwise be soiled by the makeup while temporarily setting the beauty sponge down or for drying the beauty sponge between uses, comprising:

a gripper portion formed from left and right gripper arms that have a bottom end and a top end, the bottom ends of the gripper arms pivotally connected to one another about a pivot axis, the top ends of the gripper arms each having a sponge contact portion along a depth that is parallel to the pivot axis and that runs from a front area, to a central area, to a rear area of the top end of the left and right gripper arms, the sponge contact portions facing one another along the depth thereof for releasably engaging with the beauty sponge, the sponge contact portions at the top ends of the left and right gripper arms variably spaced from one another when the left and right gripper arms are rotated about the pivot axis;

a spring for biasing the left and right gripper arms toward a closed position by applying a spring force to left and right gripper arms; and a base portion formed from left and right legs that each have a bottom end and a top end, the top ends of the left and right legs pivotally connected to one another about the pivot axis and extending integrally downward from the left and right gripper arms, respectively, the left and right legs expanding outward perpendicularly from the pivot axis to create a leg-to-leg distance of variable width between a bottom end of the left and right legs, and the bottom ends of the legs each having a surface contact portion of fixed depth along a depth that is parallel to the pivot axis, wherein the fixed depth of the surface contact portions of the left and right legs is wider than the depth of the left and right gripper arms to increase the stability of the base portion;

the sponge contact portions at the top ends of the left and right gripper arms collectively defining a sponge-gripping gap between the top ends of the left and right gripper arms that is wider in the central area than near the front or rear areas of the gripper arms so that the beauty sponge is held without formation of a fold line.

2. The beauty sponge gripper and stand of claim 1 wherein the leg-to-leg distance of variable width between the bottom end of the left and right legs is less than a width between the left and right gripper arms when a sponge is being held by the left and right gripper arms so that a user's fingers can freely extend past the relatively narrow base portion and comfortably hold the gripper portion.

3. The beauty sponge gripper and stand of claim 2 wherein the leg-to-leg distance of variable width between the bottom end of the left and right legs is about the same as a width between the left and right gripper arms when no sponge is being held by the left and right gripper arms.

4. The beauty sponge gripper and stand of claim 1 further comprising:

C-shaped cutouts at the top end of left and right gripper arms; and first and second rubber grips that engage the C-shaped cutouts.

5. The beauty sponge gripper and stand of claim 4 wherein the rubber grips include a plurality of ribs for increased gripping of the beauty sponge.

6. The beauty sponge gripper and stand of claim 1 further comprising a plurality of fingers extending inwardly from the top end of the left and right gripper arms.

7. The beauty sponge gripper and stand of claim 6 wherein the length of the plurality of fingers are varied to define the sponge-gripping gap between the top ends of the left and right gripper arms that is wider in the central area than near the front or rear areas of the gripper arms.

8. The beauty sponge gripper and stand of claim 1 further comprising a plurality of lower support fingers extending inwardly from below the top end of the left and right gripper arms to engage a lower end of the beauty sponge and provide increased support.

9. The beauty sponge gripper and stand of claim 1 wherein the spring is a coil spring, the coil spring biasing the left and right gripper arms toward a closed position by applying a spring force to left and right gripper arms via the left and right legs.

10. The beauty sponge gripper and stand of claim 1 further comprising first and second fingertip depressions formed on the left and right gripper members, respectively, so that the user may more readily control the movement of the beauty sponge gripper and stand and beauty sponge held therein.

* * * * *